US012685920B2

(12) United States Patent
Lee

(10) Patent No.: US 12,685,920 B2
(45) Date of Patent: Jul. 21, 2026

(54) MOTORIZED ROLLER SKATE

(71) Applicant: Passion Mobility Ltd., Taipei City (TW)

(72) Inventor: Chung Hsin Lee, Las Vegas, NV (US)

(73) Assignee: Passion Mobility Ltd., Taipei City (TW)

( * ) Notice: Subject to any disclaimer, the term of this patent is extended or adjusted under 35 U.S.C. 154(b) by 357 days.

(21) Appl. No.: 18/618,813

(22) Filed: Mar. 27, 2024

(65) Prior Publication Data

US 2024/0261663 A1 Aug. 8, 2024

Related U.S. Application Data

(63) Continuation-in-part of application No. 17/741,688, filed on May 11, 2022, now abandoned.

(51) Int. Cl.
*A63C 17/12* (2006.01)
*A63C 17/00* (2006.01)

(52) U.S. Cl.
CPC ..... *A63C 17/12* (2013.01); *A63C 17/0006* (2013.01); *A63C 2203/18* (2013.01)

(58) Field of Classification Search
CPC .. A63C 17/12; A63C 17/0006; A63C 2203/18
See application file for complete search history.

(56) References Cited

U.S. PATENT DOCUMENTS

| | | | | | |
|---|---|---|---|---|---|
| 5,048,632 | A * | 9/1991 | Battel | A63C 17/12 | 180/9.1 |
| 6,059,062 | A * | 5/2000 | Staelin | B60L 3/0092 | 180/181 |
| 6,428,050 | B1 * | 8/2002 | Brandley | A63C 17/12 | 280/809 |
| 7,204,330 | B1 * | 4/2007 | Lauren | A63C 17/12 | 180/181 |
| 2005/0139406 | A1 * | 6/2005 | McLeese | A63C 17/12 | 180/180 |
| 2016/0184690 | A1 * | 6/2016 | Aders | A63C 17/262 | 180/20 |
| 2020/0197786 | A1 * | 6/2020 | Artemev | A63C 17/08 | |
| 2020/0238158 | A1 * | 7/2020 | Han | A63C 17/14 | |
| 2020/0246678 | A1 * | 8/2020 | Kahan | A63C 17/226 | |
| 2022/0368208 | A1 * | 11/2022 | Lovley, II | A63C 17/26 | |
| 2023/0069904 | A1 * | 3/2023 | Hoffman | A63C 17/02 | |
| 2023/0364493 | A1 * | 11/2023 | Lee | A63C 17/26 | |
| 2024/0317072 | A1 * | 9/2024 | Soliman | A63C 17/14 | |

* cited by examiner

*Primary Examiner* — Brian L Swenson
(74) *Attorney, Agent, or Firm* — Best & Flanagan LLP

(57) ABSTRACT

A motorized roller skate having two skate boards and a hand device. Each of the skate boards and the hand device respectively has a signal device and at least one sensor. Each of the skate boards and the hand device transmits a detection signal detected by the at least one sensor to a control center via the respective signal devices.

16 Claims, 3 Drawing Sheets

MOTORIZED ROLLER SKATE

CROSS-REFERENCE TO RELATED APPLICATIONS

The present application is a continuation-in-part application of U.S. patent application Ser. No. 17/741,688, filed on May 11, 2022, now pending, of which the entire disclosure is incorporated herein by reference for all purposes.

FIELD OF INVENTION

The present invention relates to roller skates, in particular to motorized roller skates.

BACKGROUND OF THE INVENTION

Roller skates, inline skates, and quad roller skates enjoy great popularity in the field of roller sports. However, roller skates are mainly intended for recreational and sports activities and have limitations in traversing various terrains, such as inclines that may require effort to climb, making the roller skates unsuitable for long distance travel. Despite the existence of various roller skates on the market that offer power assistance by detecting changes in the wearer's foot, they often require users to overcome a steep learning curve to achieve proficient and safe use. In addition, they lack a safety mechanism to address abnormal usage scenarios such as falls or abrupt acceleration. As a result, there is an urgent need in the industry to develop roller skates that can facilitate longer distances, comfortably negotiate inclines, and incorporate safety features.

SUMMARY OF THE INVENTION

In order to develop roller skates that can facilitate long distances, comfortably negotiate inclines, and incorporate safety features, the present invention provides a motorized roller skate comprising two skate boards and a hand device, wherein each of the skate boards and the hand device respectively includes a signal device and at least one sensor. Each of the skate boards and the hand device transmits a detection signal detected by the at least one sensor to a control center via the respective signal devices.

Wherein, the detection signal may optionally include: a foot signal from one of the sensors on one of the skate boards, a hand signal from one of the sensors on the hand device, or a balance signal from one of the sensors on one of the skate boards and/or on the hand device.

Wherein, the control center is located on one of the skate boards or the hand device and stores one or more motion modes and one or more determination logics, wherein each motion mode corresponds to one of the determination logics. The control center receives the detection signals and, based on the current motion mode and determination logic, interprets the detection signals and generates a command to the signal device of at least one of the skate boards, causing the skate boards to accelerate, decelerate, maintain speed, or stop according to the command.

Wherein, when the skate boards are in operation, the control center prioritizes execution of the determination logic associated with stopping operation of the skate boards.

The present invention relates to the motorized roller skate which, through the sensors contained in the skate boards and the hand device, as well as the configured motion modes, allows the control center to generate the different commands based on the user's needs and the current status according to the corresponding determination logic for the same detection signal. In addition to allowing the motorized roller skate to facilitate longer distances and require less effort when traversing inclines, a safety mechanism is also provided to avoid danger and achieve a safer user experience.

DETAILED DESCRIPTION OF THE PREFERRED EMBODIMENTS

Figure 1:
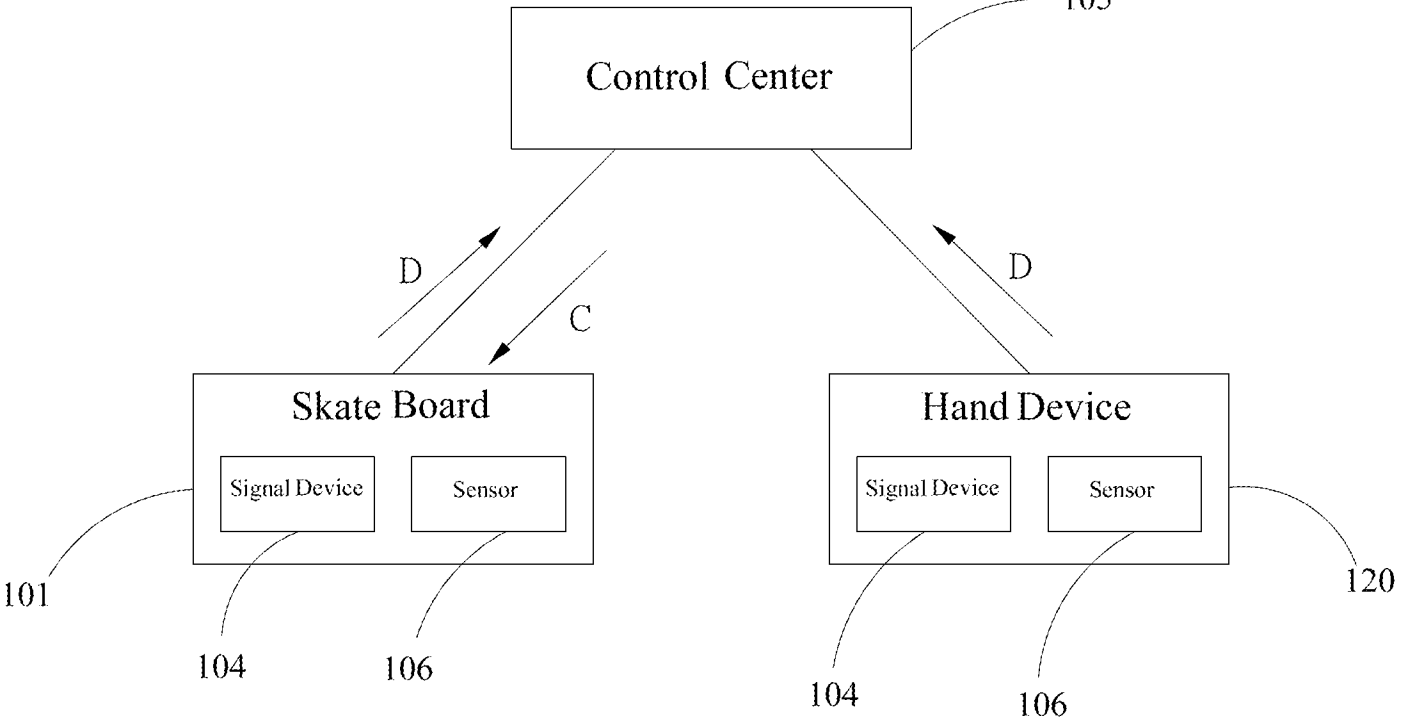
FIG. 1 is a block diagram illustrating the component relationships of a preferred first embodiment of the motorized roller skate provided by the present invention.

In order to better illustrate the purposes, solutions and technical features of the present invention, the following description provides some preferred embodiments of the present invention. The components and layouts in the embodiments are used to simply illustrate the present invention and are merely examples, not limiting requirements. For example, in the following description, a first feature formed on a second feature may include an embodiment in which the first feature and the second feature are in direct contact, or an embodiment in which an additional feature is formed between the first feature and the second feature such that the first feature and the second feature are not in direct contact. In addition, numbers and/or letters may be reused between different embodiments. The reuse of numbers and/or letters is for simplicity and clarity and does not dictate the configurational relationships between the various embodiments.

Furthermore, for ease of description, spatial terms such as "above" and "below" are used herein to describe the relative relationship of one component or feature to another component or feature. In addition to the orientations described in the drawings, the spatial relative relationships include various orientations during use or operation of the device. The device may also be oriented in other ways (or rotated 90 degrees relative to other orientations), and the spatial descriptions used herein may be interpreted accordingly.

Figure 2:
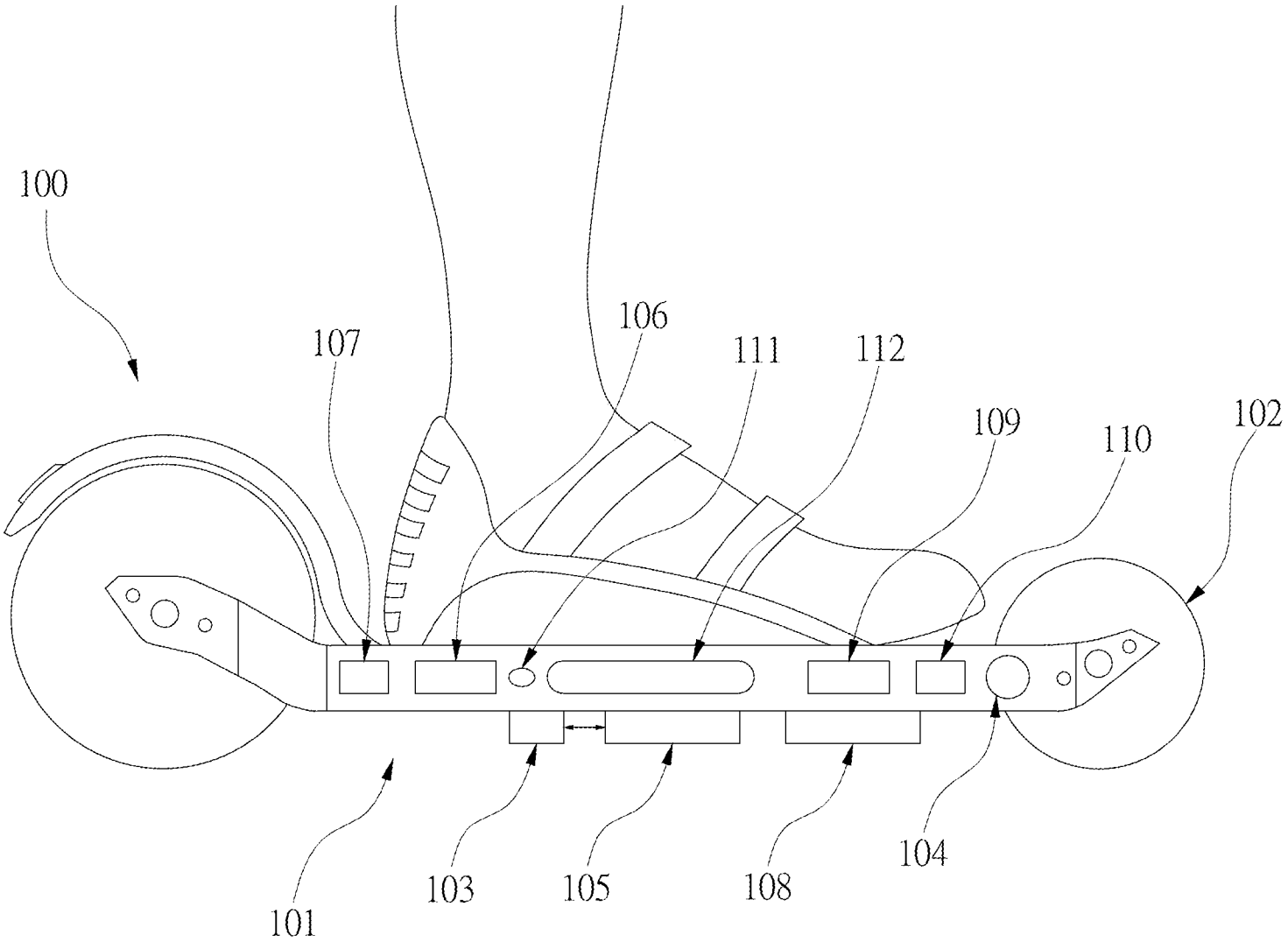
FIG. 2 is a schematic block diagram illustrating the structure of the motorized roller skate provided by the present invention.

Referring to FIGS. 1 and 2, a preferred embodiment of a motorized roller skate provided by the present invention is shown. The motorized roller skate 100 comprises two skate boards 101, a control center 105, and a hand device 120, each of the skate boards 101 and the hand device 120 including a signal device 104 and at least one sensor 106. The sensor 106 generates a detection signal D according to a detection condition, which is then transmitted via the signal device 104 to the control center 105.

Wherein, the detection signal includes a foot signal, a hand signal, and a balance signal.

The foot signal comes from the sensors 106 on the two skate boards 101. The sensors 106 on the two skate boards 101 generate the detection signal D (the foot signal) based on the detection conditions such as whether the user's feet are positioned on the skate boards 101, whether one of the user's feet is suspended in the air, the duration of time that one foot is off the ground, the interval between the two feet alternately leaving the ground, changes in the center of gravity of one of the user's feet, and whether the user has given a pre-stored foot gesture command.

Wherein, the foot gesture command can be performed by actions such as pressing down with the toes, lifting the toes, or pressing down vertically on one of the skate boards 101.

The hand signal comes from the sensors 106 on the hand device 120. The sensors 106 on the hand device 120 generate the detection signal D (the hand signal) based on the detection conditions of whether the hand device 120 is shaken by the user's hand, whether the shake arc of the hand device 120 is irregular, the duration of the shake received by the hand device 120, and whether the user has given a pre-stored hand gesture command.

The balance signal comes from the sensors 106 on the two skate boards 101 and/or the hand device 120. The sensors 106 generate the detection signal D (the balance signal) based on the detection conditions such as the swinging state of the user's feet and/or hands.

The control center 105 receives the detection signal D from at least one of the skate boards 101 and/or the remote hand device 120 and, based on stored determination logic, interprets the detection signals D after combining the foot signal, the hand signal, and the balance signal. The control center 105 then generates a command C to the signal device 104 of at least one of the skate boards 101, causing the skate boards 101 to accelerate, decelerate, maintain speed, or stop accordingly.

Wherein, the control center 105 determines whether the detection signal D is the foot gesture command or the hand gesture command based on the determination logic, and generates the corresponding command C such as start, accelerate, maintain speed, or decelerate to control the operation of the motorized roller skate.

It should be noted that the determination logic can determine whether to generate the deceleration or stop command C based on the hand signal and the balance signal. When riding the motorized roller skate, it is difficult to avoid that one of the sensors 106 positioned on the skate boards 101 generates an incorrect foot signal and foot gesture command due to changes in the road conditions, causing the control center to generate an incorrect command C (especially the acceleration command). In such a case, if the control center can evaluate the error in addition to the hand signal and the balance signal, it can generate the command C appropriate to the current riding status of the user, thereby achieving a safety mechanism for the motorized roller skate.

For example, when the user is skating downhill, if one of the sensors 106 detects the detection signal D of the user pressing down with the toes, and another sensor 106 also detects the detection signal D with a changed balance signal due to the user leaning forward, such that the control center can determine that the user has entered the downhill path based on the determination logic, and avoid generating the acceleration command C.

For example, if one of the sensors 106 detects the detection signal D of the skate board 101, and another sensor 106 detects the detection signal D of the user's hand waving erratically and irregularly, while another sensor 106 also detects the detection signal D of the user's balance signal changing constantly, the control center can determine that the user may be in an unbalanced state based on the determination logic, and generate the deceleration or stop command C to prevent the user from falling.

Furthermore, the control center 105 stores one or more motion modes so that the user can choose to operate the motorized roller skate using the two skate boards 101 and the hand device 120 individually or jointly according to their needs, and the determination logic adapts accordingly to the selected motion mode. This enables the control center to generate the different commands C for the same detection signal D. For example, the motion modes may include a passive mode, an assisting mode, and an automatic mode. The motorized roller skate 100 can turn the assisting mode and/or automatic mode on or off as needed via the foot gesture command and/or hand gesture command.

In the passive mode of the motorized roller skate 100, the user can ride the motorized roller skate 100 only by propelling the two skate boards 101 with their own gliding force, which is no different from regular roller skates.

In one embodiment, in the assisting mode of the motorized roller skate 100, the motorized roller skate 100 is activated by the user's own gliding force on the two skate boards 101. The sensors 106 on the two skate boards 101 individually detect whether the user's two feet cause the two skate boards 101 to leave the ground, the duration of the two skate boards 101 being off the ground, and form the detection signal D to be transmitted to the control center 105. The control center 105 evaluates, based on the determination logic, whether the interval between the two feet alternately leaving the ground is within a preset time. If the interval is within the preset time, the control center 105 gives the command C to the two skate boards 101 to provide auxiliary power to maintain the current speed.

If the interval between the two feet alternately leaving the ground is not within the preset time, or if no detection signal D from a foot landing is continuously detected, the control center 105 gives the command C to stop.

In one embodiment, the motorized roller skate 100 enters the automatic mode via the foot gesture command while in the assisting mode. The difference from the previous embodiment is that when the control center 105 evaluates, based on the determination logic, that the interval between the two feet alternately leaving the ground is within the preset time, the control center 105 gives the command C to the two skate boards 101 to generate an acceleration effect.

It should be noted that since the motorized roller skate 100 is in the assisting mode at the same time, when the sensors 106 detect that the gliding force of the user on one of the skate boards 101 is smaller compared to the previous gliding force on one of the skate boards 101, the control center 105 gives the command C to the two skate boards 101 to maintain the current speed to avoid excessive acceleration of the motorized roller skate 100.

Wherein, regardless of whether the motorized roller skate 100 is in the assisting mode or the automatic mode, when the pre-stored foot gesture command, the hand gesture command, or the determination logic for initiating the stop command C is detected, the control center 105 prioritizes the execution of the stop command C.

The control center 105 can be a control circuit attached to the remote hand device 120 or one of the skate boards 101. The control center 105 may also be, for example, a central processing unit (CPU).

Furthermore, the remote hand device 120 can be a mobile phone or an electronic watch.

Wherein, the two skate boards 101 each provide a space for accommodating the left foot and the right foot of the user. Each of the skate boards 101 includes at least one roller 102, at least one motor 103, the signal device 104, the sensor 106, a switch 107, and at least one battery 108. The two skate boards 101 are connected via the signal devices 104, allowing the two skate boards 101 to operate synchronously and at the same speed, thereby providing the user with a pleasant experience.

In one embodiment, the signal device 104 may be a wireless communication device such as Bluetooth, Zigbee wireless technology, Global Positioning System (GPS), Wi-Fi, satellite television, and wireless computer parts. In some embodiments, the signal device 104 may be a wired communication device. The type of communication device 104 used in the present invention is not limited.

The sensor 106 is used to detect and monitor whether the user's foot is positioned on the skate board 101. Specifically, the sensor 106 can monitor whether one of the user's feet is in the air while the other foot, heel, or toes are off the ground. Through the detection signal transmitted by the sensor 106, the user can control the motorized roller skate 100 through actions and postures. The detection signal includes an angle, speed, and inclination of the skate board 101 during use. The sensor 106 may include an accelerometer, a gyroscope, a pressure device, and a magnetic device to perform various detection functions in the motorized roller skate 100. The type of sensor 106 used in the present invention is not limited.

The motorized roller skate 100 is an electrically powered roller skate. The motorized roller skate 100 is driven by the at least one motor 103 installed on the multiple skate boards 101. The multiple skate boards 101 may be made of plastic, metal, or other suitable board materials, the present invention does not limit the types of materials used for the skate boards 101 of the motorized roller skate 100. The multiple skate boards 101 may be circular, triangular, rectangular, or square in shape, the present invention does not limit the shape of the skate boards 101. In one embodiment, the skate board 101 includes a strap for securing the user's foot. In some embodiments, the skate board 101 includes a clamp for securing the user's foot. The present invention does not limit the manner in which the skate board 101 supports or secures the user's foot. In one embodiment, the length of the skate board 101 is shorter for better maneuverability of the motorized roller skate, while in some embodiments the length of the skate board 101 is longer. It should be noted that the length and height of the skate board 101 are not limited.

Figure 3:
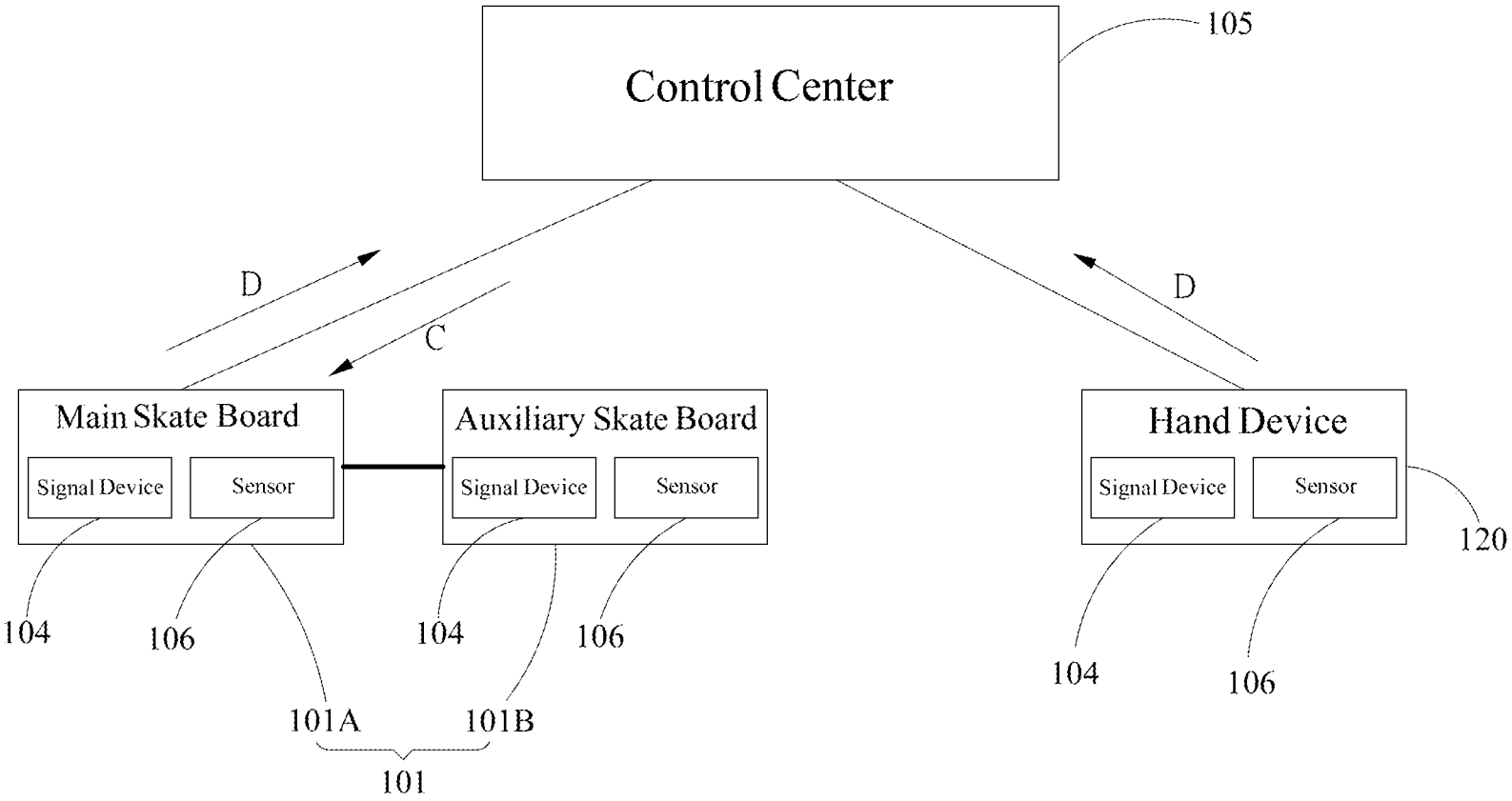
FIG. 3 is a block diagram illustrating the component relationships of a preferred second embodiment of the motorized roller skate provided by the present invention.

Referring to FIG. 3, in one embodiment, the two skate boards 101 can be further divided into a main skate board 101A and an auxiliary skate board 101B. The main skate board 101A and the auxiliary skate board 101B are signal-communicated via the signal device 104. The main skate board 101A receives the detection signal D from the auxiliary skate board 101B and transmits the detection signal D from the main skate board 101A and/or the auxiliary skate board 101B to the control center 105. Similarly, the command C from the control center 105 is transmitted only to the main skate board 101A, allowing the main skate board 101A to control the auxiliary skate board 101B of the motorized roller skate 100 according to the control center 105.

Wherein, when the main skate board 101A receives the detection signal D from the auxiliary skate board 101B, the main skate board 101A can perform a preliminary signal verification to determine whether the detection signal D from the auxiliary skate board 101B is correct. This can prevent the control center 105 from receiving the detection signals D from both skate boards 101 simultaneously, resulting in an incorrect determination and generating incorrect commands.

Wherein, the main skate board 101A or the auxiliary skate board 101B can be set for the left or right foot of the user as needed.

In one embodiment, two rollers 102 are installed at the rear end of each skate board 101 and one roller 102 is installed at the front end of each skate board 101. The present invention does not limit the number and location of rollers 102 installed on each skate board 101. In one embodiment, the diameters of all of the rollers 102 are the same size, while in some embodiments, the diameters of the rollers 102 are different sizes. The present invention does not limit the size of the rollers 102.

In one embodiment, acceleration or deceleration of the motorized roller skate 100 can be achieved by the user lightly pressing the roller 102 with the foot to generate the detection signal D.

The multiple motors 103 are installed on each skate board 101. The motorized roller skate 100 achieves the ability to climb hills and descend slopes by turning on or off the motors 103 on the skate boards 101. By turning the motors 103 on or off, the motorized roller skate 100 can operate in the passive mode, the assisting mode, or the automatic mode to enhance the user's experience. Specifically, when the motors 103 are turned off, the motorized roller skate 100 operates in the passive mode. Similarly, when the motors 103 are turned on, the motorized roller skate 100 operates in the assisting mode or automatic mode.

In one embodiment, only one roller 102 on each skate board 101 can be electrically driven, while in some embodiments, more than one roller 102 on each skate board 101 can be electrically driven. The present invention does not limit the number of rollers 102 on the motorized roller skate 100 that can be electrically driven. It should be noted that the position of the motors 103 installed on each skate board 101 is not limited.

In one embodiment, the motor 103 is a brushless DC motor, while in some embodiments, the motor 103 may be a permanent magnet DC motor, a series DC motor, a shunt DC motor, or a compound DC motor. The type of motor 103 used in the motorized roller skate 100 is not limited. It should be noted that the operation of turning the motor 103 on or off is controlled by the actions or postures of the user's feet.

The switch 107 may be a mechanical switch or an electrical switch. The user can lightly press the switch 107 with one foot to turn the motorized roller skate 100 on or off.

The multiple batteries 108 are connected to each skate board 101. The battery 108 is used to power the motorized roller skate 100 and activate the motor 103. The motorized roller skate 100 may use a lithium polymer battery (LiPo), a lithium-ion battery (Li-ion), or a lithium iron phosphate battery (LiFePo). The present invention does not limit the type of battery 108 used in the motorized roller skate 100.

Preferably, each skate board 101 may also separately include a charging circuit 109, a regenerative power circuit 110, multiple LED lights 111, and a display 112.

The charging circuit 109 is for charging the battery 108. The charging circuit 109 can simultaneously charge the right skate board and the left skate board through a charging cable. In another embodiment, the charging circuit 109 can charge each skate board 101 separately through the charging cable. In another embodiment, the charging circuit 109 can charge the battery 108 by docking the motorized roller skates 100.

The regenerative power circuit 110 is connected to the skate board 101. The regenerative power circuit 110 is used to charge the battery 108 when the motorized roller skate 100 is decelerating. Specifically, when the motorized roller skate 100 is decelerating, the regenerative power circuit 110 can recover a certain percentage of electrical energy and feed the electrical energy back to the battery 108, allowing the motorized roller skate 100 to travel a longer distance without incurring additional costs.

The multiple LED lights 111 are installed on the skate board 101 to indicate the status of the motorized roller skate 100. The multiple LED lights 111 can provide the status of the motorized roller skate 100 as a warning or reminder to the user.

The display 112 is attached to the skate board 101 to inform the user of the status of the motorized roller skate 100 and any subsequent actions that need to be taken. The display 112 can display information in a text format, and can also play voice prompts along with the text format. The display 112 may be an LED, LCD, or OLED display. The type of display 112 used in the present invention is not limited.

Wherein, the multiple LED lights 111 and/or the display 112 may also be installed on the hand device 120, allowing the user to more intuitively confirm the status of the motorized roller skate 100 through the multiple LED lights 111 and/or the display 112.

The present invention relates to the motorized roller skate that, through the sensors 106 contained in the skate boards 101 and the remote hand device 120 as well as the configured motion modes, allows the control center 105 to generate the different commands C based on the user's needs and the current status according to the corresponding determination logic for the same detection signal D. In addition to allowing the motorized roller skate 100 to facilitate longer distances and require less effort when traversing inclines, a safety mechanism is also provided to avoid danger and achieve a safer user experience.

The above descriptions have outlined features of various embodiments for the better understanding of those skilled in the relevant art. Those skilled in the pertinent art should understand that they can readily design or modify other processes and structures based on the disclosure of the present invention to serve the same purposes and/or achieve the same technical features provided by the embodiments of the present invention. Those skilled in the art should also recognize that such equivalent structures do not depart from the spirit and scope of the present invention, and that various modifications, substitutions and changes can be made to the present disclosure without departing from the spirit and scope of the present invention.

What is claimed is:

1. A motorized roller skate comprising two skate boards and a hand device, wherein each of the skate boards and the hand device respectively comprises a signal device and at least one sensor, and each of the skate boards and the hand device transmits a detection signal detected by the at least one sensor to a control center via the respective signal devices, wherein the detection signal comprises: a foot signal from one of the sensors on one of the skate boards or a hand signal from one of the sensors on the hand device; and a balance signal from one of the sensors on one of the skate boards and/or the hand device; and the control center is located on one of the skate boards or the hand device, and the control center stores one or more motion modes and one or more determination logics, each motion mode corresponding to one of the determination logics, wherein the control center receives the detection signals and, based on the current motion mode and determination logic, interprets the detection signals and generating a command to the signal device of at least one of the skate boards to accelerate, decelerate, maintain speed, or stop the skate boards according to the command; wherein, when the skate boards are in operation, the control center prioritizes execution of the determination logic associated with stopping operation of the skate boards.

2. The motorized roller skate according to claim 1, wherein the detection of the sensors on the two skate boards comprises positions of feet of a user on the skate boards, whether the two skate boards are off the ground, a time duration of each instance of the two skate boards being off the ground, an interval between the two skate boards alternately leaving the ground, and changes in the center of gravity of the feet of the user.

3. The motorized roller skate according to claim 2, wherein the sensors on the hand device detect whether the hand device is shaking, whether the shake arc of the hand device is erratic and irregular, and a continuous duration of the hand device receiving the shake.

4. The motorized roller skate according to claim 3, wherein the control center determines, based on one determination logic, whether the detection signal is a pre-stored foot gesture command or a hand gesture command, and generates a command corresponding to the foot gesture command or the hand gesture command.

5. The motorized roller skate according to claim 4, wherein the foot gesture command is performed by pressing down with toes, lifting the toes, or vertically pressing down on one of the skate boards.

6. The motorized roller skate according to claim 4, wherein one or more of the motion modes is turned on or off by the foot gesture command and/or the hand gesture command.

7. The motorized roller skate according to claim 6, wherein the motion modes comprise an assisting mode, when the assisting mode is turned on, the two skate boards receive a gliding force to initiate gliding, the sensors on the two skate boards individually detect whether the two skate boards are off the ground and the time duration of being off the ground to form the detection signal, the control center evaluates, based on the determination logic corresponding to the assisting mode, whether the interval between the two skate boards alternately leaving the ground is within a preset time, and if the interval is within the preset time, the control center gives the command to generate an auxiliary power for the two skate boards; if the interval is not within the preset time, the control center gives the command to stop.

8. The motorized roller skate according to claim 7, wherein the motion modes comprise an automatic mode, when the automatic mode is performed, the control center evaluates, based on the determination logic corresponding to the automatic mode, if the interval is within the preset time, the control center gives the command to generate an acceleration power for the two skate boards.

9. The motorized roller skate according to claim 8, wherein the control center gives the command to the two skate boards to provide the auxiliary power to maintain the current speed when the sensor detects that the gliding force received by one of the skate boards is smaller then the previous gliding force.

10. The motorized roller skate according to claim 9, wherein the two skate boards are respectively a main skate board and an auxiliary skate board, and the main skate board and the auxiliary skate board are signal-communicated via the signal device, and the main skate board receives the detection signal from the auxiliary skate board and transmits the detection signal from the main skate board and/or the auxiliary skate board to the control center, and the control center transmits the command to the main skate board.

11. The motorized roller skate according to claim 10, wherein the main skate board performs signal verification on the detection signal from the auxiliary skate board before transmitting the detection signal to the control center.

12. The motorized roller skate according to claim 10, wherein the main skate board is optionally set for the user's left foot or right foot.

13. The motorized roller skate according to claim 10, wherein the skate board comprises at least one roller, and the at least one roller is driven by at least one motor, wherein when the motor is turned on, the control center executes the assisting mode and/or the automatic mode.

14. The motorized roller skate according to claim 10, wherein each of the skate boards and the hand device respectively comprises a battery and a charging circuit to charge the battery.

15. The motorized roller skate according to claim 14, wherein a regenerative power circuit is connected to the skate board, and the regenerative power circuit charges the battery when the motorized roller skate decelerates.

16. The motorized roller skate according to claim 10, wherein an LED light or a display is installed on one of the skate boards and/or the hand device.

* * * * *